US005448159A

United States Patent [19]

Kojima et al.

[11] Patent Number: 5,448,159

[45] Date of Patent: Sep. 5, 1995

[54] REFERENCE VOLTAGE GENERATOR

[75] Inventors: Makoto Kojima; Tatsumi Sumi, both of Osaka; Naomi Miyake, Kyoto, all of Japan

[73] Assignee: Matsushita Electronics Corporation, Osaka, Japan

[21] Appl. No.: 241,993

[22] Filed: May 12, 1994

[51] Int. Cl.[6] ..... G05F 3/20

[52] U.S. Cl. ..... 323/315; 323/313

[58] Field of Search ..... 323/312, 313, 314, 315, 323/316

[56] References Cited

U.S. PATENT DOCUMENTS

| | | | |
|---|---|---|---|
| 4,525,663 | 6/1985 | Henry | 323/313 X |
| 4,961,009 | 10/1990 | Baik | 307/296.8 |
| 5,146,152 | 9/1992 | Jin et al. | 323/314 X |
| 5,304,918 | 4/1994 | Khieu | 323/315 |
| 5,339,020 | 8/1994 | Siligoni et al. | 323/313 |

FOREIGN PATENT DOCUMENTS 63-244217 10/1988 Japan .

*Primary Examiner*—A. D. Pellinen
*Assistant Examiner*—Y. Jessica Han
*Attorney, Agent, or Firm*—Willian Brinks Hofer Gilson & Lione

[57] ABSTRACT

A current mirror is composed of N-MOS transistors N1, N2, a diode-connected P-MOS transistor P1 is connected to an output side of the current mirror, and a source of a P-MOS transistor P2 controlled according to the gate potential of the P-MOS transistor P1 is connected to a power source $V_{CC}$ via a polysilicon resistor R. The drain of the P-MOS transistor P2 is connected to the drain of the N-MOS transistor N2. A current-mirror-connected N-MOS transistor N3 is provided at the current mirror of the N-MOS transistors N1, N2. The output of the N-MOS transistor N3 is inputted to another current mirror composed, on the power source $V_{CC}$ side, of two P-MOS transistors P3, P4, a constant current is outputted from the drain of one of the two P-MOS transistors P3, P4 and received by a load circuit which is the series-parallel connection of diode-connected P-MOS transistors P5–P8, and the voltage generated at the load circuit is outputted as a reference voltage output $V_{REF}$. Thereby a negative temperature dependency that the reference voltage $V_{REF}$ drops at high temperature and rises at low temperature is cancelled or is made positive.

16 Claims, 12 Drawing Sheets

REFERENCE VOLTAGE GENERATOR

BACKGROUND OF THE INVENTION

This invention relates to a reference voltage generator used in a semiconductor integrated circuit.

Recently, elements in a semiconductor integrated circuit, especially in a dynamic RAM are being further miniaturized, with a result of lowering of a voltage suitable for deriving the transistor performance maximally. While, the power source voltage supplied to the dynamic RAM is not lowered. Therefore, an internal reduced-voltage generator is provided for lowering the voltage inside of the chip. In such a reduced-voltage generator, a reduced voltage based on a voltage generated at a reference voltage generator is supplied into the chip.

FIG.11 shows a conventional reference voltage generator (refer to Laid Open unexamined Japanese Patent Application No.63-244217). As shown in FIG.11, P-MOS transistors P100, P200 which are diode-connected from a power source $V_{CC}$ are provided in series at a first column and an N-MOS transistor N100 is connected in series between the P-MOS transistor P200 and a ground GND. At a second column, N-MOS transistors N300, N200 which are diode-connected from the ground GND are provided in series and a P-MOS transistor P300 is connected in series between the N-MOS transistor N200 and the power source $V_{CC}$. The gate of the N-MOS transistor N100 and gate and drain of the N-MOS transistor N200 are connected to a node 200. The potential of the node 200 is the reference voltage $V_{REF}$. The gate of the P-MOS transistor P300 and gate and drain of the P-MOS transistor P200 are connected to a node 100. Accordingly, the output of the first column is inputted to the gate of the P-MOS transistor P300 via the node 100 to control the output of the second column and the output of the second column is inputted to the gate of the N-MOS transistor N100 via the node 200 to control the output of the first column, which is the feedback construction. For example, in FIG.11, the reference voltage output $V_{REF}$ can be expressed by an equation (1), provided that all the MOS transistors are equal in gate length to one another and are operated in a saturation region. Wherein an absolute value of a threshold voltage of the P-MOS transistor is $V_{TP}$, a mobility coefficient thereof is k'p, a threshold voltage of the N-MOS transistor is $V_{TN}$, a mobility coefficient thereof is k'n, a gate width of the P-MOS transistor P300 is Wp, a gate width of the N-MOS transistor N100 is Wn, each gate width of the other MOS transistors is W, and a symbol * means multiplication.

$$V_{REF}=2*V_{TN}*(1+2*(Wp*Wn/W^2)^{0.5})+2*(Wp*k'p/(W*k'n))^{0.5}*V_{TP} \quad (1)$$

As indicated in the equation (1), the reference voltage output $V_{REF}$ can set according to the gate width of each transistor, depends on the threshold voltages of the MOS transistors and is independent from the source voltage $V_{CC}$. Also, the reference voltage $V_{REF}$ can set according to the gate length (not indicated in the equation (1)). The condition for operating all the MOS transistors in the saturation region is that the power source voltage ($V_{CC}$)>the set reference voltage output ($V_{REF}$)$-V_{TN}+2*V_{TP}$, so that the reference voltage output $V_{REF}$ is constant with reference to the power source voltage $V_{CC}$.

In this way, the conventional reference voltage generator which easily determines the reference voltage according to the transistor size, using the threshold voltages of P-type and N-type MOS transistors, is independent from the power source voltage in a large range of the power source voltage but fairly depends on temperature. In detail, the threshold voltage of each of P-type and N-type MOS transistors which is to be the reference of the reference voltage generation depends on temperature and the absolute value thereof drops at high temperature. Therefore, as cleared from the equation (1), the reference voltage output $V_{REF}$ drops at high temperature. Such the state is shown in FIG.12, which is a result of actual measurement of the conventional circuit manufactured. As cleared from the drawing, 3.30 V reference voltage output at 25° C. deviates to 3.15 V at 100° C. which means 0.15 V (4.5%) drop to 75° C. temperature change. Such the temperature dependency involves problems of lowering of the device speed at high temperature and increase of current consumption of the device at low temperature.

SUMMARY OF THE INVENTION

The present invention has its object of providing a reference voltage generator having a small power source voltage dependency and a small temperature dependency.

To attain the above object, in the present invention, a load circuit having a negative temperature dependency and composed of a series-parallel connection of a plurality of MOS transistors each of which is diode-connected is connected to a constant current source having a positive temperature dependency whose current value is determined by a current mirror circuit, a plurality of MOS transistors composing two loads of the current mirror circuit and a single resistor so that the voltage generated by the load circuit is outputted as the reference voltage.

According to the above construction with the constant current source of current mirror circuit, the output current of the constant current source has a small power source voltage dependency. Thus, the generated reference voltage has the small power source voltage dependency. Further, combination of the plural MOS transistors composing the load circuit enables free setting of the temperature dependency of the reference voltage. In other words, according to a power source voltage converter using the reference voltage generator in the present invention, a semiconductor integrated circuit is contemplated which has the small temperature dependency that prevents the lowering of the device speed due to lowering of the reference voltage at high temperature and the rise of the current consumption of the device at low temperature. Reversely, it is possible to increase the reference voltage at high temperature so as to generate a reference voltage with a positive temperature dependency which compensates the lowering of the device speed at high temperature.

DETAILED DESCRIPTION OF THE INVENTION

Description is made below about six embodiments of the present invention.

(FIRST EMBODIMENT)

Figure 1:
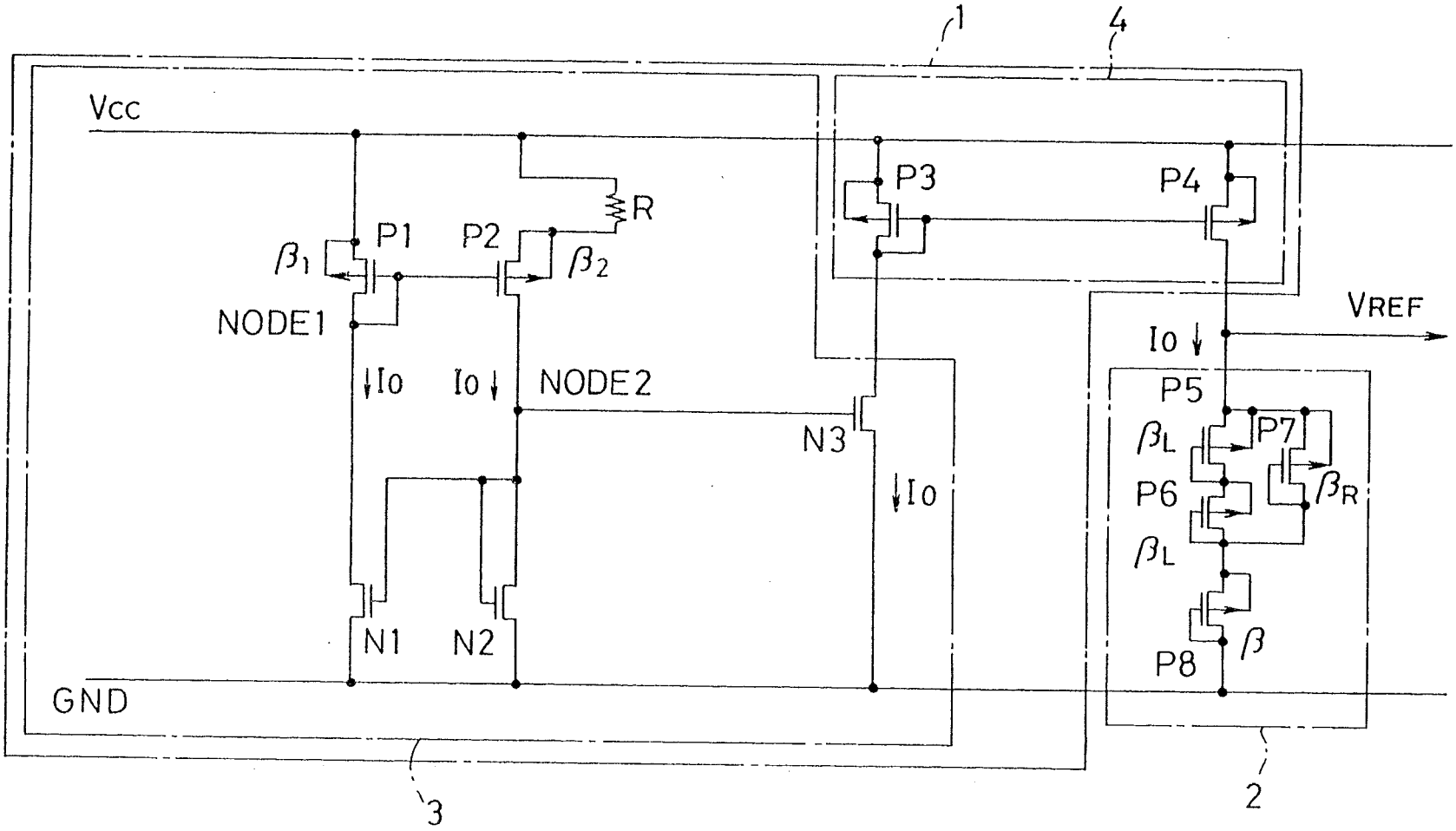
FIG. 1 is a diagram showing a reference voltage generator according to a first embodiment of the present invention.

A reference voltage generator according to the first embodiment of the present invention is discussed first, with reference to FIG. 1.

This circuit is divided into tow blocks of a constant current source 1 for supplying a constant current irrespective of a power source voltage and a load circuit 2 composed of P-MOS transistors, and outputs a voltage generated at the load circuit 2 as a reference voltage $V_{REF}$. The reference voltage generator has an extremely small temperature dependency by cancelling the temperature dependency as a whole by a positive temperature dependency of the current value outputted from the constant current source 1 and a negative temperature dependency of the output voltage to the input current of the load circuit 2. The constant current source 1 is composed of a fundamental constant current source 3 and a circuit 4 for converting a voltage level of the current source.

The circuit operation of the fundamental constant current source 3 is described, with reference to FIG. 1.

In FIG. 1, a current mirror is composed of N-MOS transistors N1, N2 and an output side thereof is connected to a diode-connected P-MOS transistor P1. A source of a P-MOS transistor P2 whose gate is controlled by a potential equivalent to the gate potential of the P-MOS transistor P1 is connected to a power source $V_{CC}$ via a polysilicon resistor R. The P-MOS transistor P2 is connected at a drain thereof to a drain of the N-MOS transistor N2. An N-MOS transistor N3 current-mirror-connected is provided at the current mirror of the N-MOS transistors N1, N2, which is the output of the current source 3.

The voltage level converting circuit 4 inputs the output of the current source 3 to the input side (P-MOS transistor P3) of current mirror composed of P-MOS transistors P3, P4 on the power source $V_{CC}$ side to output the constant current from the drain of the P-MOS transistor P4.

In this reference voltage generator, when all the MOS transistors are operated in a saturation region and mirror ratios of the N-MOS transistors N1, N2, N3 and the P-MOS transistors P3, P4 are respectively set to 1:1:1 and 1:1 for the convenience sake, the output I0 of the constant current source 1 is given as an equation (2).

$$I0=R^{-2}*((1/\beta_1)^{0.5}-(1/\beta_2)^{0.5})^2 \quad (2)$$

$\beta_1$: gain coefficient of P-MOS transistor P1

$\beta_2$: gain coefficient of P-MOS transistor P2

The load circuit 2 is a series-parallel connection of diode-connected P-MOS transistors P5–P8.

For the convenience sake, a case of the load circuit is considered where same sized, diode-connected P-MOS transistors in n in number are simply connected in series. In this case, the reference voltage output $V_{REF}$ is given by an equation (3).

$$V_{REF}=n*(I0/\beta)^{0.5}+n*V_{TP} \quad (3)$$

$\beta$: gain coefficient of P-MOS transistor $V_{TP}$: absolute value of threshold voltage of P-MOS transistor According to the equations (2), (3), the reference voltage output $V_{REF}$ is introduced into an equation (4).

$$V_{REF}=(V_{REFO}-n*V_{TPO})/(\alpha_{R(T)}*\alpha_{B(T)})+-n*\alpha_{VTP(T)}*V_{TPO} \quad (4)$$

$V_{REFO}$: set value of reference voltage at 25° C.

$V_{TPO}$: absolute value of threshold voltage of P-MOS transistor at 25° C.

$\alpha_{R(T)}$: temperature coefficient of resistance relative to resistance at 25° C. for expressing resistance of resistor at T° C.

$\alpha_{B(T)}$: temperature coefficient of gain coefficient relative to gain coefficient at 25° C. for expressing gain coefficient of P-MOS transistor at T° C.

$\alpha_{VTP(T)}$: temperature coefficient of threshold voltage relative to threshold voltage at 25° C. for expressing threshold voltage of P-MOS transistor at T° C.

The second term in the equation (4) has a negative temperature dependency because it is a term for the threshold voltage of the P-MOS transistor, so that the second term is increased as increase in number n. The first term is a reciprocal term of a product of the temperature coefficient of the gain coefficient of the P-MOS transistor and the temperature coefficient of the resistor, and become small as the number n is increased.

When a reciprocal of the temperature coefficient of the resistor, a reciprocal of the temperature coefficient of the gain coefficient of the P-MOS transistor and the temperature coefficient of the threshold voltage of the P-MOS transistor in the equation (4) are primary-approximated, equations (5)–(7) are obtained. $\alpha_{RO}$ in the equation (5) varies according to material of the resistor. The temperature dependency of the gain coefficient of the P-MOS transistor is almost determined according to the temperature dependency of hole mobility, as the equation (6). The temperature dependency of the threshold voltage of the P-MOS transistor is as the equation (7).

$$1/\alpha_{R(T)}=1+\alpha_{RO}*(T-25) \quad (5)$$

$\alpha_{RO}$: resistance variation ratio to temperature $$1/\alpha_{B(T)}=1+4.93*10^{-3}*(T-25) \quad (6)$$

$$\alpha_{VTP(T)}=V_{TPO}-2.0*10^{-3}*(T-25) \quad (7)$$

Figure 2:
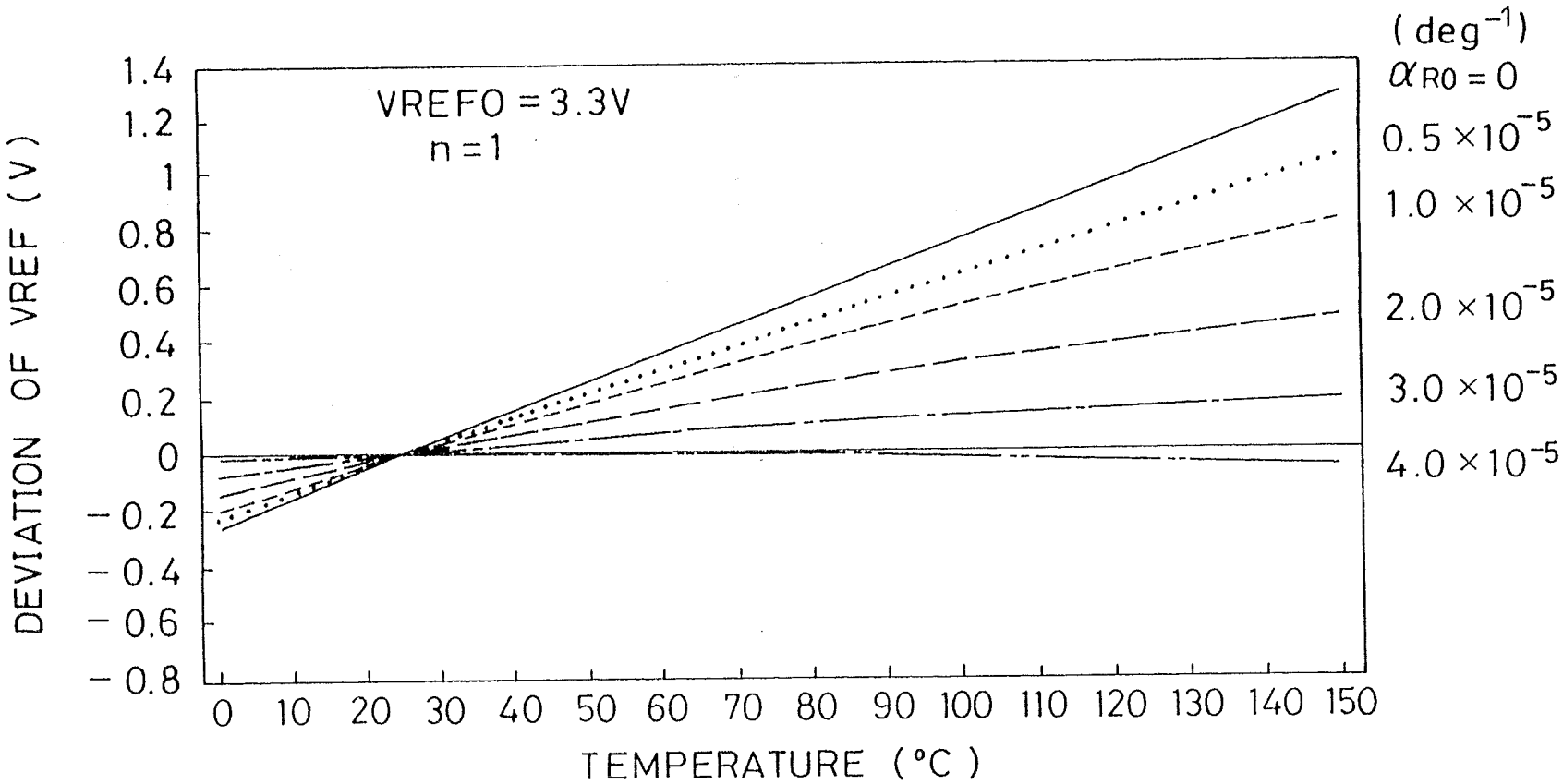
FIG. 2 is a graph showing a deviation of reference voltage depending on temperature (reference of $V_{REF}$: 25° C.) in case where a load circuit in FIG. 1 is composed of one P-MOS transistor in series.
Figure 3:
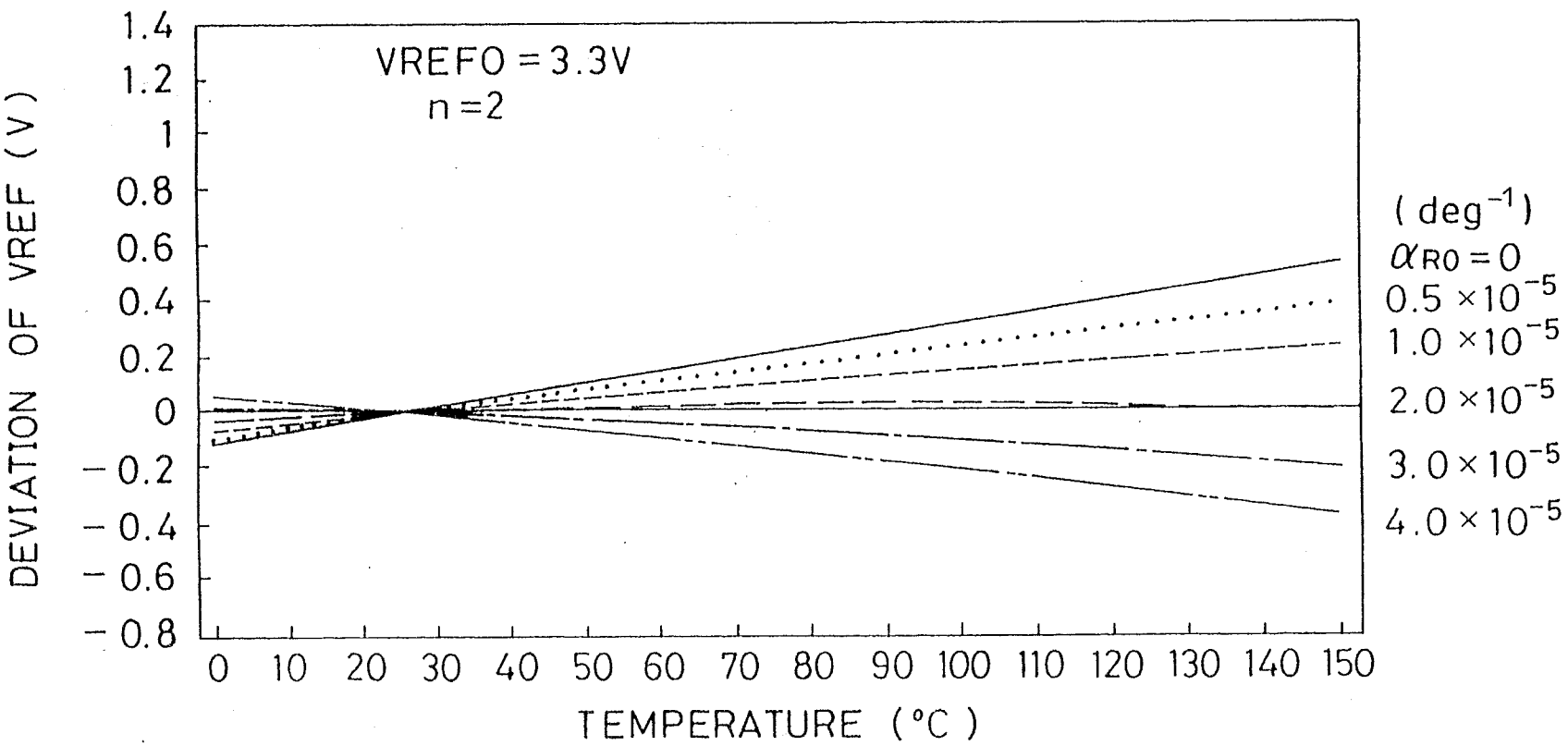
FIG. 3,is a graph corresponding to FIG. 2 in case where the load circuit in FIG. 1 is composed of two P-MOS transistors in series.
Figure 4:
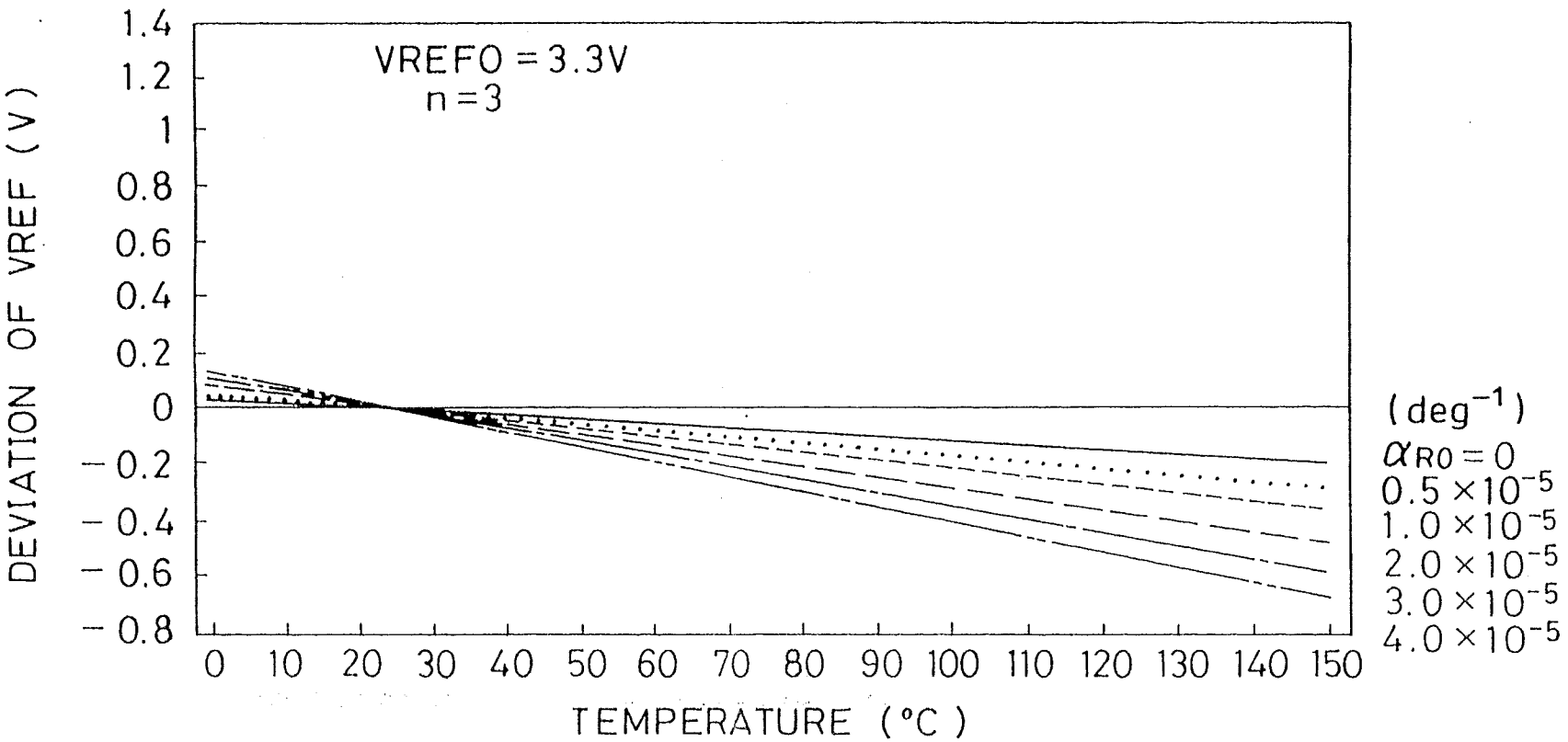
FIG. 4 is a graph corresponding to FIG. 2 in case where the load circuit in FIG. 1 is composed of three P-MOS transistors in series.

Using the equations (4)–(7), deviation of the reference voltage output $V_{REF}$ according to temperature change is calculated and shown in FIGS. 2–4. In respective figures, $\alpha_{RO}$ is taken as a parameter, and one, two or three P-MOS transistor(s) of the load circuit is/are connected respectively. Wherein, the reference voltage $V_{REFO}$ is 3.3 V and the threshold voltage $V_{TPO}$ of the P-MOS transistors is 0.8 V at 25° C.

Though the resistance variation ratio $\alpha_{RO}$ is the same, the deviation ratio of the reference voltage $V_{REF}$ to temperature decreases as the number of the P-MOS transistors of the load circuit increases from one to two or three, so that the reference voltage $V_{REF}$ has the negative temperature dependency with the three P-MOS transistors even when the resistance variation ratio $\alpha_{RO}$ is 0. When the resistance variation ratio $\alpha_{RO}$ is $4.0*10^{-5}deg^{-1}$, the reference voltage output $V_{REF}$ even with one P-MOS transistor (when n is the smallest number, 1) has the negative temperature dependency. Therefore, when a N-well resistor or the like having the resistance variation ratio $\alpha_{RO}$ of about $4.0*10^{-5}deg^{-1}$ is used in this circuit, temperature compensation cannot be performed, thus the temperature dependency of the reference voltage $V_{REF}$ cannot be zero. The resistance variation ratio $\alpha_{RO}$ of a polysilicon resistor to which impurity is heavily doped is about $0.43*10^{-5}deg^{-1}$. As to the temperature dependency at the resistance variation ratio $\alpha_{RO}$ of $0.5*10^{-5}deg^{-1}$, the deviation of the reference voltage $V_{REF}$ at around 100° C. is about +0.2 V with two P-MOS transistors of the load, and about −0.15 V with three load P-MOS transistors thereof. Accordingly, it is cleared that the temperature compensation should be performed corresponding to the number of transistors therebetween. To obtain an intermediate characteristic other than integer-numbered transistors, such as two and three transistors, the load circuit 2 is composed of four diode-connected P-MOS transistors P5–P8, where P5, P6 and P8 are connected in series to one another and P7 is connected in parallel to P5 and P6, as in this embodiment, thus cancelling the almost temperature dependency.

Figure 5:
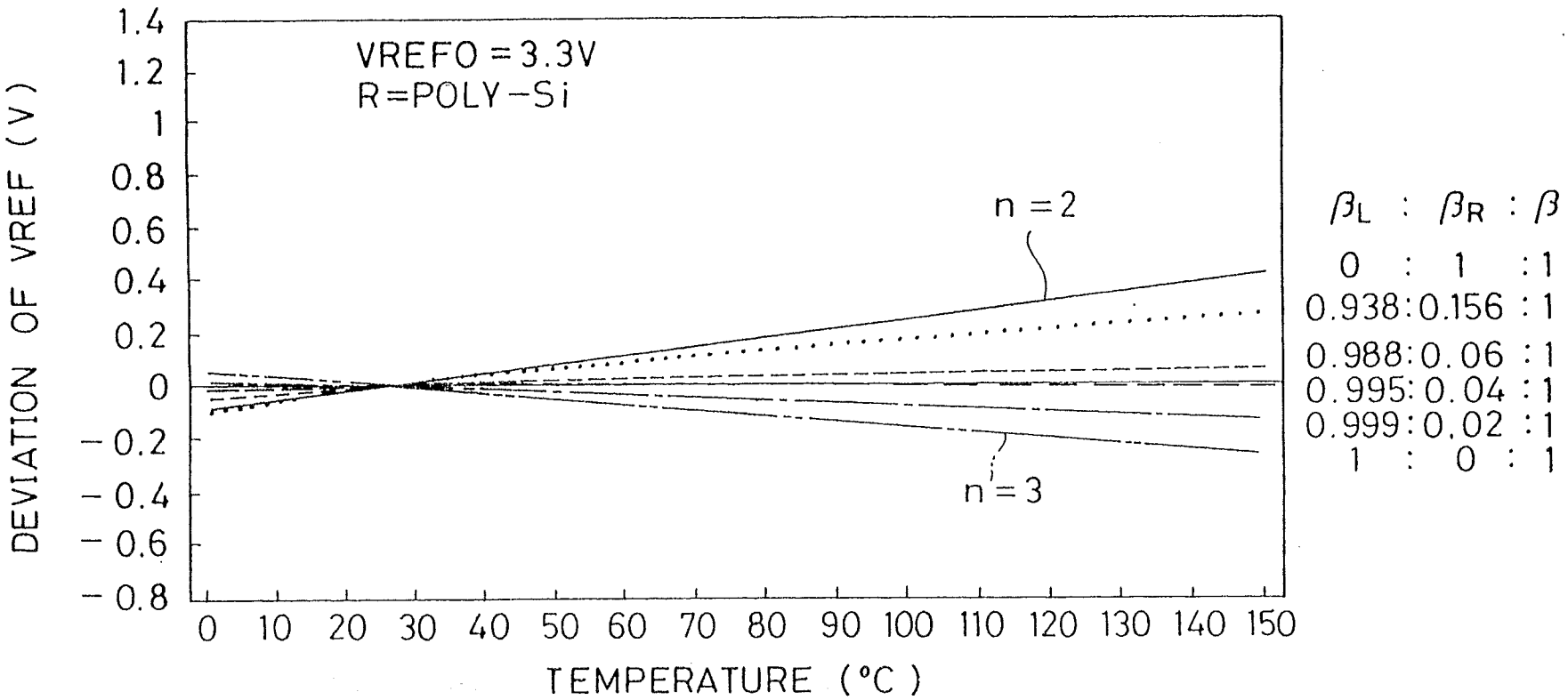
FIG. 5 is a graph showing a deviation of reference voltage depending on temperature (reference of $V_{REF}$: 25° C.) in the reference voltage generator in FIG. 1.

FIG. 5 is a graph showing a temperature dependency of the reference voltage $V_{REF}$ deviation calculated in case of a gain coefficient ratio $\beta L;\beta R:\beta$ of the P-MOS transistors of: the parallelly-connected MOS transistors P5, P6 at left column; the MOS transistor P7 at right column; and the MOS transistor P8 on ground side is set to 0:1:1, 0.938:0.156:1, 0.988:0.06:1, 0.995:0.04:1, 0.999:0.02:1 and 1:0:1. The set reference voltage and the threshold voltage are the same as the above at 25° C. As the gain coefficient $\beta L$ ratio of the two series transistors P5, P6 increases, the temperature dependency with two transistors gradually approximates that with three transistors. When the gain coefficient ratio $\beta L:\beta R:\beta$ is 0.995:0.04:1, the deviation of the reference voltage $V_{REF}$ is within 20 mV in a range between 0° C. and 150° C., which means generation of the reference voltage with extremely small temperature dependency.

In this way, using the polysilicon resistor, R and the load circuit 2 in FIG. 1, the temperature dependency is adjustable.

In this embodiment, the constant current is outputted from the MOS transistor P4 via the MOS transistors N3, P3. However, the same effects can be obtained by connecting the gate of the P-MOS transistor P4 directly to the gate of the P-MOS transistor P1. The conductive types of P and N of all the MOS transistors can be reversed. In this case, the MOS transistor corresponding to the P-MOS transistor P3 can be replaced by a load circuit composed of a plurality of diode-connected MOS transistors.

(SECOND EMBODIMENT)

Figure 6:
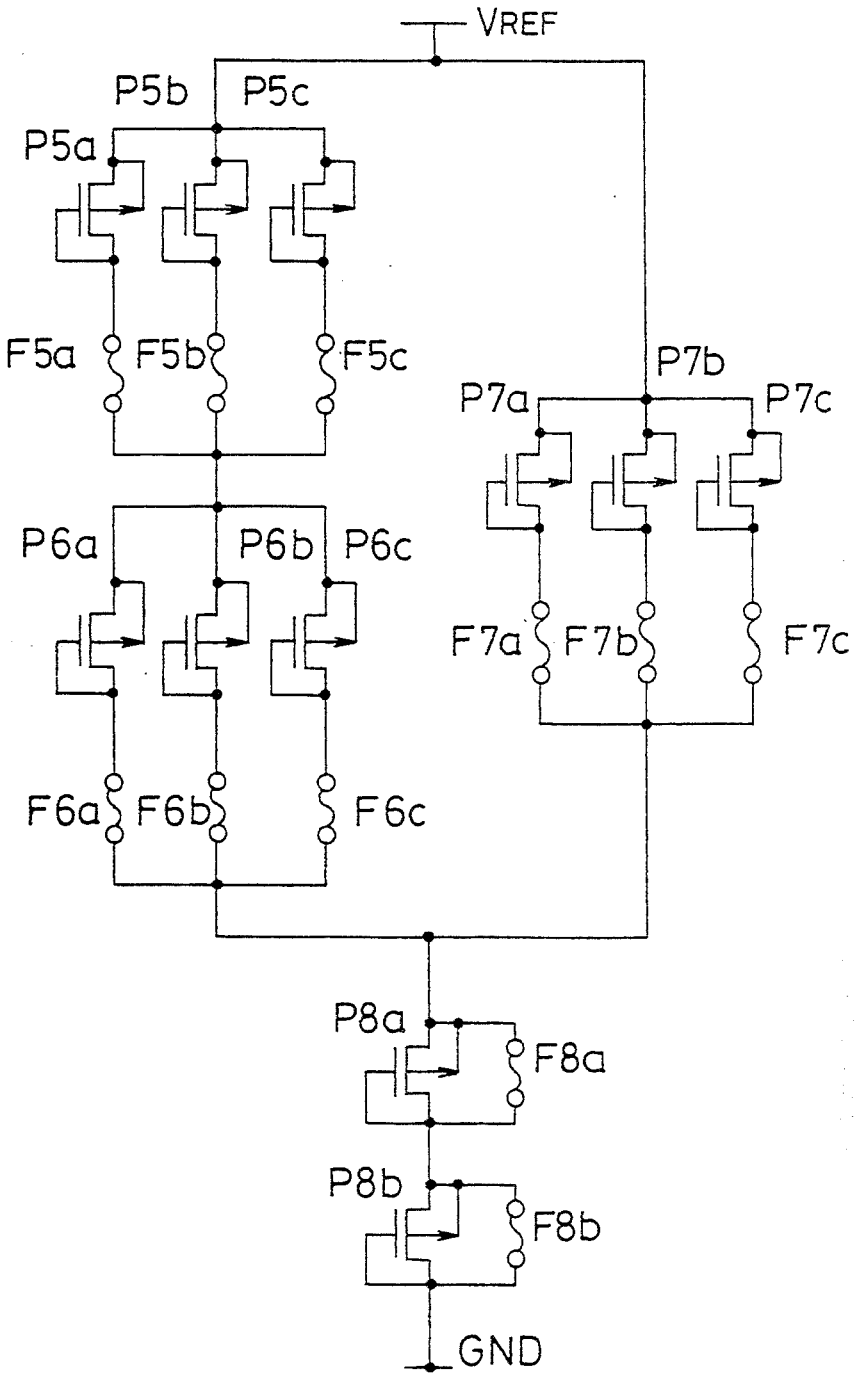
FIG. 6 is a diagram showing a load circuit in a reference voltage generator according to a second embodiment of the present invention.

The reference voltage generator according to the second embodiment of the present invention is discussed, with reference to FIG. 6.

The load circuit 2 in the first embodiment is composed of only the P-MOS transistors. While fuses are added in such the construction in the second embodiment. In detail, the load circuit is composed of two types of units: a first type of unit comprises plural unit circuits in which diode-connected P-MOS transistors and fuses are connected in series and the plural unit circuits are connected in parallel to one another; and a second type of unit comprises plural unit circuits in which diode-connected P-MOS transistors and fuses are connected in parallel and the plural unit circuits are connected in series to one another. As mentioned above, by adjusting the combination of the series-parallel connection of the diode-connected P-MOS transistors and the size of each transistor, the temperature dependency is changed. Accordingly, by trimming some of optional fuses after a wafer process by laser or the like, the combination in series-parallel of the P-MOS transistors and the effective size thereof are changed, with a result that the output voltage and the temperature dependency thereof can be adjusted.

(THIRD EMBODIMENT)

Figure 7:
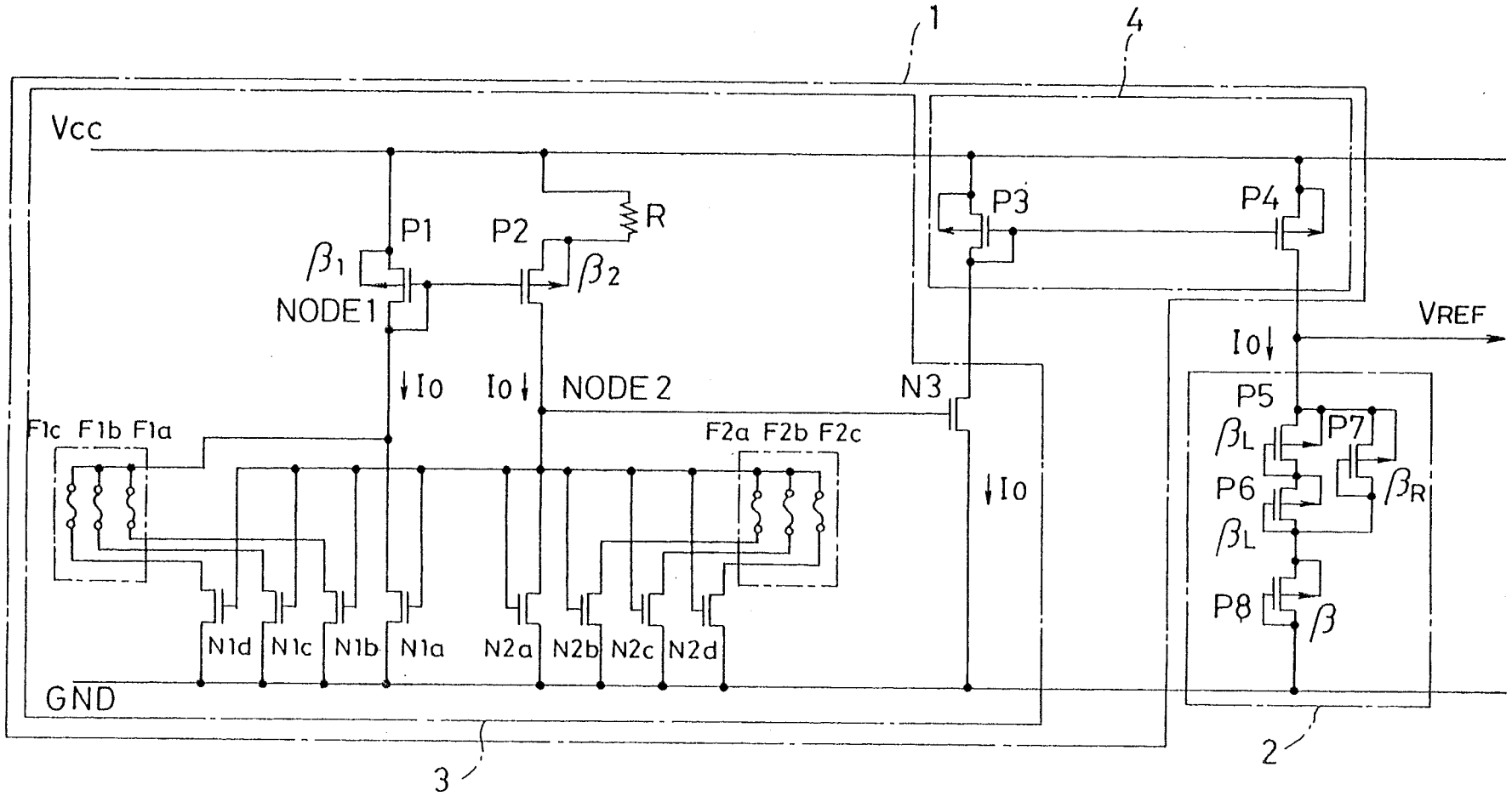
FIG. 7 is a diagram showing a reference voltage generator according to a third embodiment of the present invention.

Referring to FIG. 7, the reference voltage generator according to the third embodiment of the present invention is discussed next.

In this reference voltage generator, the N-MOS transistors N1, N2 composing the constant current source in the first embodiment are respectively changed into N-MOS transistors N1*a*–N1*d*, N2*a*–N2*d*, and fuses F1*a*–F1*c*, F2*a*–F2*c* are connected respectively to the drains of the N-MOS transistors N1*b*–N1*d*, N2*b*–N2*d*. Accordingly, the mirror ratio is changed in such a manner that the size ratio of the MOS transistors on NODE1 side and NODE2 side which compose the current mirror is changed by trimming the fuses F1*a*–F1*c*, F2*a*–F2*c*, thus adjusting the set current I0. The transistor size is designed in case without fuse trimming, using a standard device parameter, the wafer process is advanced, the reference voltage is measured at a wafer test step, then the fuses F1*a*–F1*c*, F2*a*–F2*c* are adequately trimmed according to the deviation amount from the set value. The set current I0 is decreased by trimming the fuses on NODE1 side, accompanying the drop of the reference voltage $V_{REF}$. On the other hand, the set current I0 is increased by trimming the fuses on NODE2 side, accompanying the rise of the reference voltage $V_{REF}$. In this way, the effective device size is changeable by the fuse trimming, which enables fine adjustment of the reference voltage after the wafer process even with the deviation of the reference voltage due to process fluctuation, and enables to output a given reference voltage.

(FOURTH EMBODIMENT)

Figure 8:
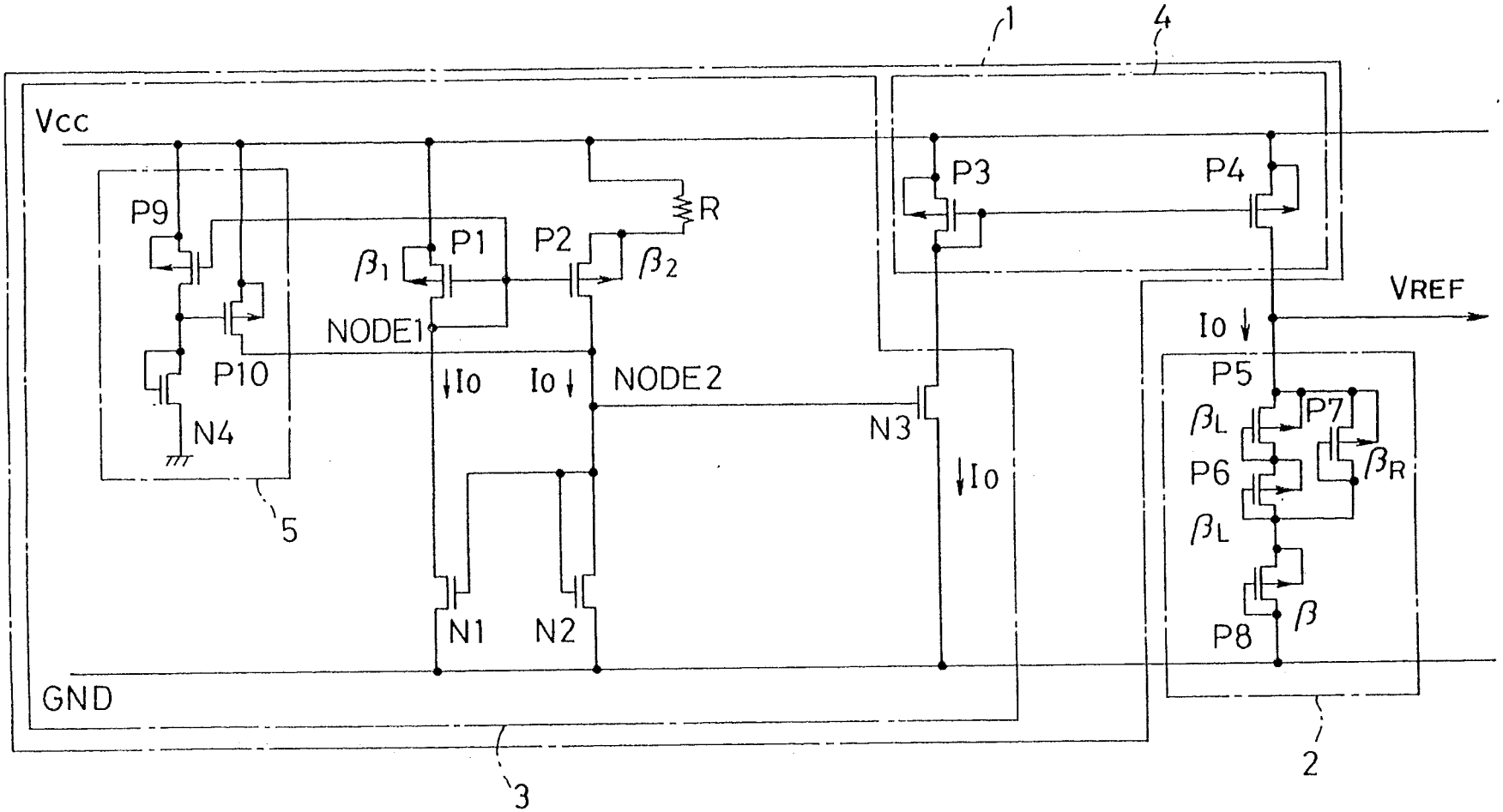
FIG. 8 is a diagram showing a reference voltage generator according to a fourth embodiment of the present invention.

Described next is about the reference voltage generator according to the fourth embodiment of the present invention, with reference to FIG. 8.

In this reference voltage generator, a start-up circuit 5 for time at power initiation is added to the circuit composing the constant current source 3 in the first embodiment. The circuit composed of the MOS transistors P1, P2, N1, N2 has two stable points of a case where the set current I0 flows through each of NODE1 and NODE2 and of a case where the current is zero. In this embodiment, the current flowing on NODE1 side is detected by an inverter composed of the P-MOS transistor P9 current-mirror-connected to the P-MOS transistor P1 and the diode-connected N-MOS transistor N4. In case where no current flows, the current is made flow into NODE2 via the P-MOS transistor P10 and the gate potentials of the N-MOS transistors N1, N2 in current mirror connection is made increased to thus make the transistor N1 be in ON state. Thereby, the voltage of NODE1 drops, the P-MOS transistor P1 is ON and the P-MOS transistors P2, P9 are in ON state. With the P-MOS transistor P2 ON, the current flows into NODE2 to feedback NODE1 side and NODE2 side. While, with the P-MOS transistor P9 ON, the current flowing into NODE2 via the P-MOS transistor P10 is halted and feedback-operated by the set current I0.

Such the addition of the start-up circuit for time at power initiation contemplates the highly-reliable reference voltage generator which is operated by the set current without exception. In addition, irrespective of the value of the power source voltage $V_{CC}$, the P-MOS transistor P10 maintains ON state after start up, which is favorable.

(FIFTH EMBODIMENT)

Figure 9:
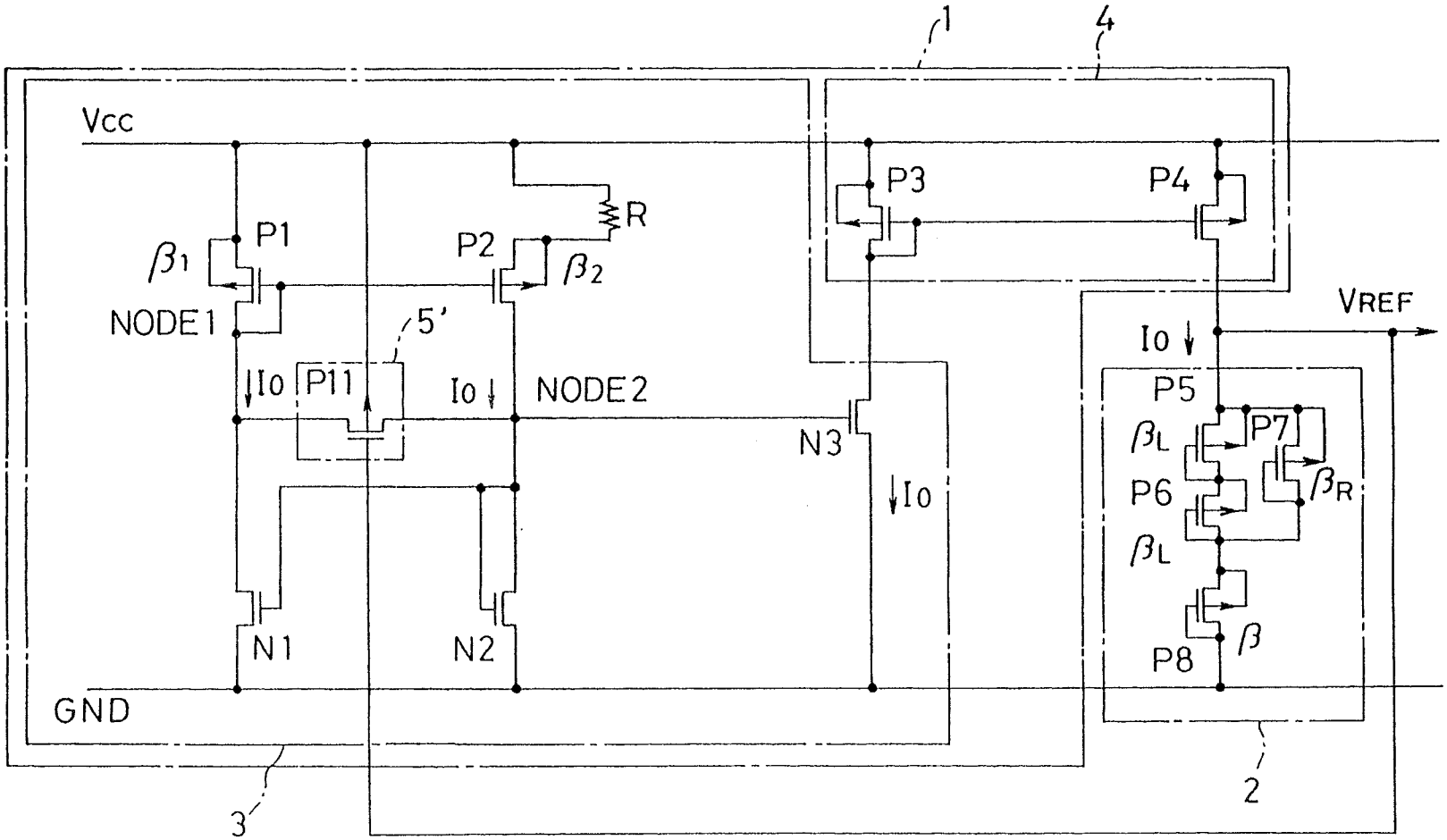
FIG. 9 is a diagram showing a reference voltage generator according to a fifth embodiment of the present invention.

Hereinafter discussed is the reference voltage generator according to the fifth embodiment of the present invention, with reference to FIG. 9.

In this reference voltage generator, a start-up circuit 5' for time at power initiation is added to the circuit composing the constant current source 3 in the first embodiment. The current I0 in the figure occasionally does not flow right after the power initiation. The potential of NODE1 is at least $V_{CC}-V_{PT}$, the potential of NODE2 is not exceeding $V_{TN}$ and the output voltage $V_{REF}$ is 0 V when the current I0 is zero. Accordingly, the P-MOS transistor P11 is in ON state, the current is made flow from NODE1 into NODE2 and the gate potential of the current-mirror-connected N-MOS transistors N1, N2 is increased, thus the transistor N1 is made to be in ON state. This and the current flow from NODE1 into NODE2 drop the voltage of NODE1, make the P-MOS transistor P1 ON and make the P-MOS transistor P2 to be in ON state. Thereby, the current I0 of the feedback loop of the constant current source 3 is initiated. When the current I0 flows, the potential of NODE1 drops and the output voltage $V_{REF}$ rises. Therefore, according to the power source voltage or the device size, the P-MOS transistor P11 is in OFF state or approximates to OFF state. By reducing the size of the P-MOS transistor P11 or by setting the steady-state voltage between NODE1 and the power source large, the current flowing via the P-MOS transistor P11 within a specified voltage range is made less than the set current I0 not to influence the output voltage $V_{REF}$. As well as in the fourth embodiment, the addition of such the start-up circuit for time at power initiation contemplates the highly-reliable reference voltage generator which is operated by the set current without exception.

(SIXTH EMBODIMENT)

Figure 10:
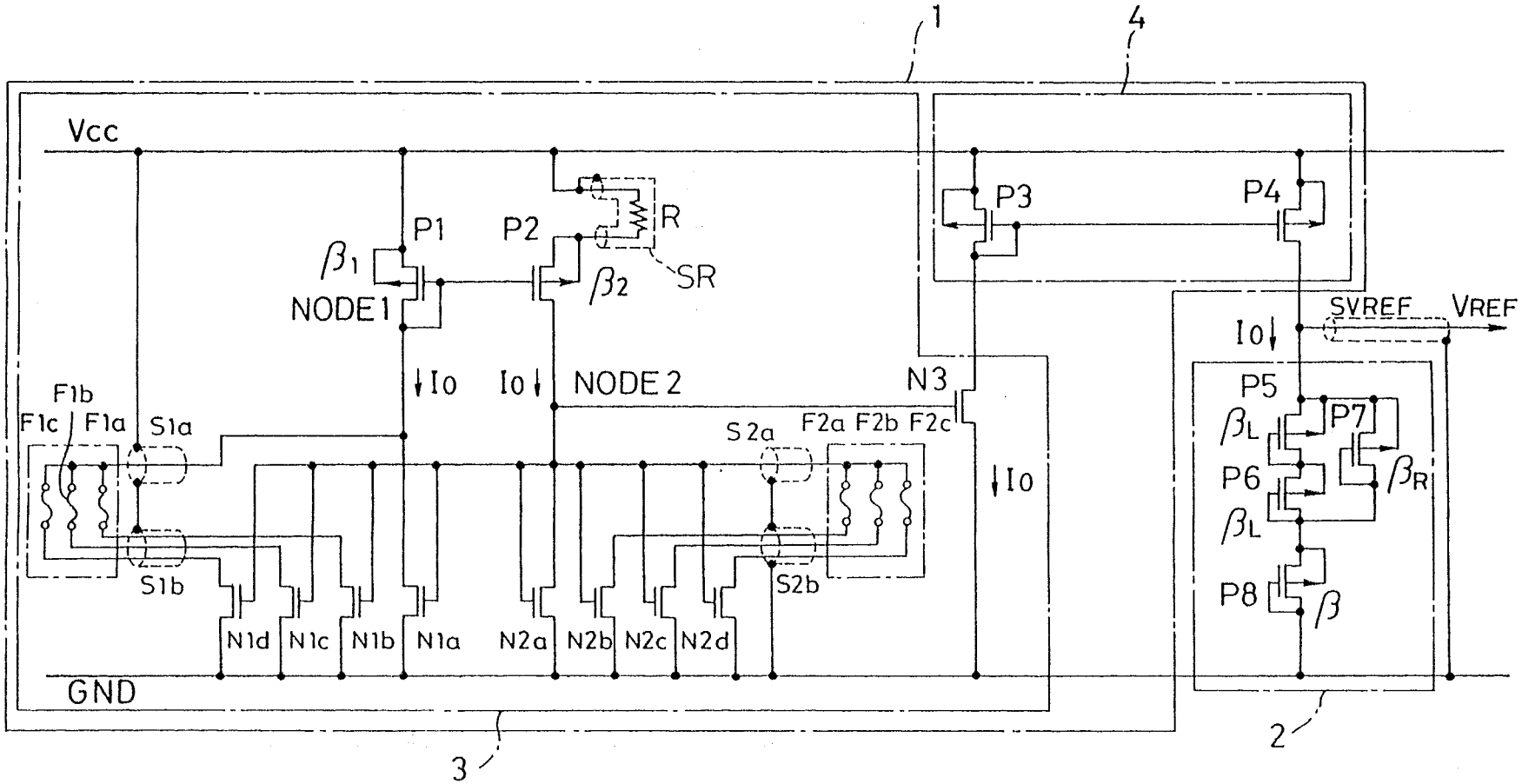
FIG. 10 is a diagram showing a reference voltage generator according to a sixth embodiment of the present invention.
Figure 11:
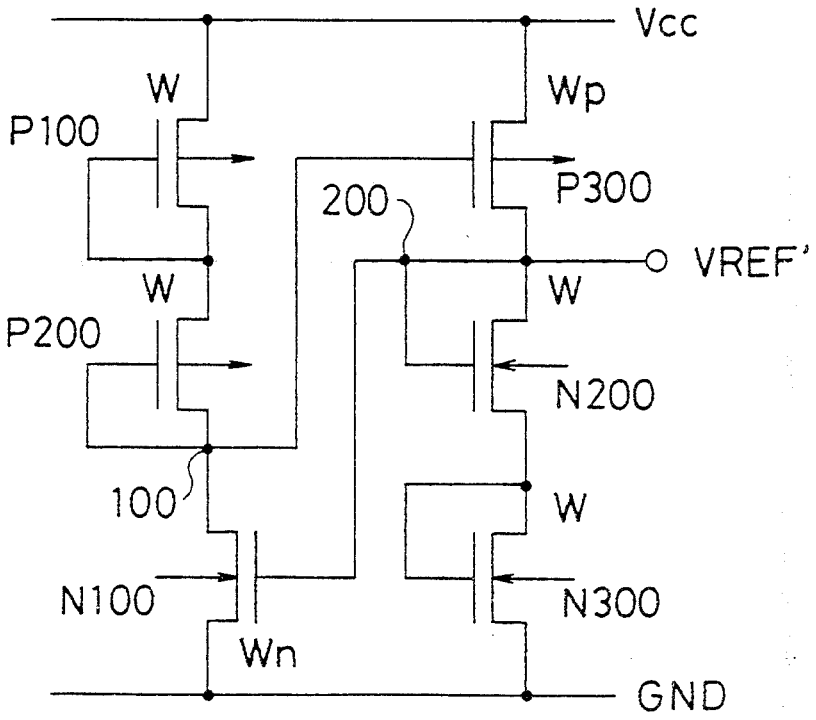
FIG.11 PRIOR ART
FIG. 11 is a diagram showing a conventional reference voltage generator.
Figure 12:
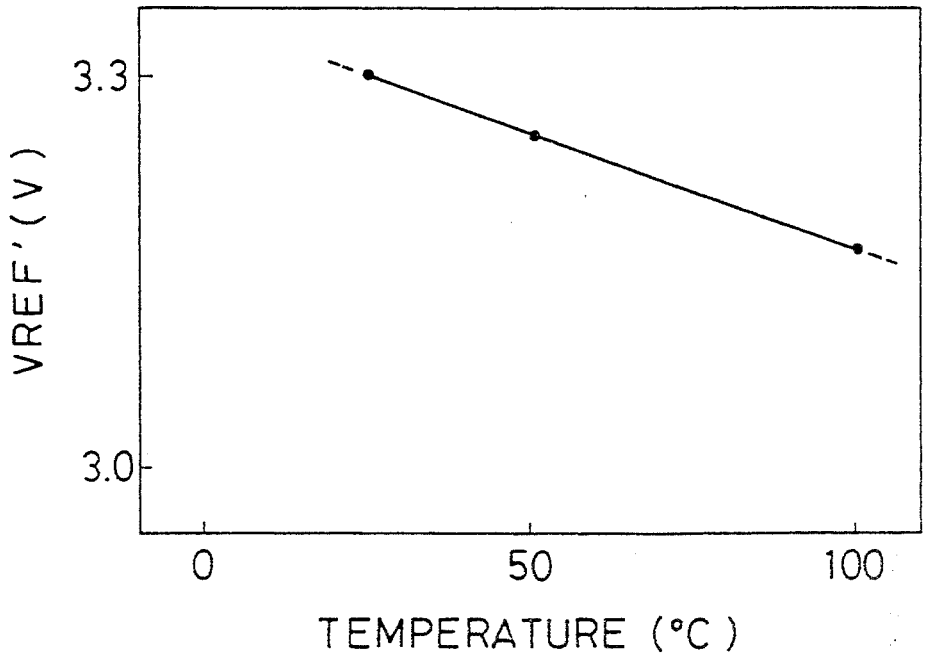
FIG.12 PRIOR ART
FIG. 12 is a graph showing a temperature dependency of the reference voltage in the conventional reference voltage generator.

Description is made below about the reference voltage generator according to the sixth embodiment of the present invention, with reference to FIG. 10.

In this embodiment, shields S1*a*, S1*b* are respectively provided to wirings from NODE1 and the drains of the N-MOS transistors N1*b*–N1*d* to the respective fuses F1*a*–F1*c*, a shield SR is provided to the resistor R and a connection wiring thereof, thus introducing shields at the power source potential. Further, shields S2*a*, S2*b* are respectively provided to wirings from NODE2 and the drains of the N-MOS transistors N2*b*–N2*d* to the respective fuses F2*a*–F2*c* and a shield $S_{VREF}$ is provided to a wiring for the reference voltage $V_{REF}$, thus introducing shields at the ground GND potential. The reason thereof is as follows.

Because of the necessity of restraining the standby current in a dynamic RAM or the like, the current consumption is saved as far as possible in a circuit which is required to be always in operation such as the reference voltage generator, so that the signal impedance of each node is extremely high and rises to several megaohms. Therefore, the wirings and the resistor which are pulled out from the layout of the circuit are susceptible to noise of other signals owing to coupling with the adjacent wirings or with lower or upper layers of the wirings due to stray capacitance, which deviates the reference voltage easily. For this reason, the power source potential shield and the ground potential shield are provided, as in this embodiment, to inhibit the noise from the substrate and the other wirings. The shielding provides the stray capacitance between the signal line and the shield potential. This makes, contrarily, liable to receive the noise from the shield potential. In other words, in general, the power source noise and ground noise are made susceptible. In the circuit in the present invention, all the node potentials are independent from the power source voltage and are constant based on either the power source or the ground. In this embodiment, the power source potential shield or the ground potential shield is used according to whether the node potential is constant based on the power source or the ground GND, with a result of less deviation of the reference voltage output $V_{REF}$ due to the power source noise or the ground noise on the signal lines. Thus, generated is the stable reference voltage immune to the power source noise and the signal noise.

We claim:

1. A reference voltage generator having a constant current source for generating a current having a small power source voltage dependency and a positive temperature dependency, and a load circuit connected to said constant current source so as to generate a reference voltage according to the current of said constant current source, said constant current source comprising:

a current mirror circuit composed of a plurality of MOS transistors;

first and second loads connected to said current mirror circuit so as to determine a current value of said constant current source, wherein said first load comprises a first MOS transistor which is diode-connected to a power source, said second load comprises a second MOS transistor having a gate connected to a gate and a drain of said first MOS transistor, and a resistor intervened between said second MOS transistor and said power source, said current mirror circuit has functions of inputting a drain current of said second MOS transistor and supplying a drain current to said first MOS transistor with a constant mirror ratio so as to determine a current value of said constant current source, and said load circuit comprises a combination of series-parallel connection of a plurality of MOS transistors each of which is diode-connected and is selected in size so as to set a value of the reference voltage and so as to cancel the positive temperature dependency of the current of said constant current source.

2. A reference voltage generator having a constant current source for generating a current having a small power source voltage dependency and a positive temperature dependency, and a load circuit connected to said constant current source so as to generate a reference voltage according to the current of said constant current source, said constant current source comprising:

a first first-conductive type MOS transistor having a source connected to a first power source;

a second first-conductive type MOS transistor having a source connected to said first power source;

a third first-conductive type MOS transistor having a gate connected to a gate of said first first-conductive type MOS transistor and a gate and a drain of said second first-conductive type MOS transistor and a source connected to said first power source;

a first second-conductive type MOS transistor intervened between a second power source and a drain of said first first-conductive type MOS transistor so as to be diode-connected in a forward direction;

a second second-conductive type MOS transistor having a drain connected to the drain of said second first-conductive type MOS transistor and a gate connected to a gate of said first second-conductive type MOS transistor;

a resistor having a resistance having a smaller temperature dependency than a temperature dependency of a threshold voltage of said first and second second-conductive type MOS transistors, and being intervened between the source of said second second-conductive type MOS transistor and said second power source;

a third second-conductive type MOS transistor intervened between said second power source and the drain of said third first-conductive type MOS transistor so as to be diode-connected in a forward direction; and a fourth second-conductive type MOS transistor having a gate connected to the gate of said third second-conductive type MOS transistor, a source connected to said second power source and a drain for outputting the current of said constant current source, wherein said load circuit comprises a combination of series-parallel connection of a plurality of MOS transistors each of which is diode-connected and is selected in size so as to set a value of the reference voltage and so as to cancel the positive temperature dependency of the current of said constant current source.

3. The reference voltage generator of claim 2, wherein said first first-conductive type MOS transistor comprises:

a plurality of sub MOS transistors connected in parallel to one another; and a plurality of fuses for trimming which are respectively intervened in current paths of said plural sub MOS transistors.

4. The reference voltage generator of claim 3, wherein respective wirings between said plural sub MOS transistors and said plural fuses are shielded from a substrate on which said reference voltage generator is fabricated and from other signal wirings with a conductor having a potential of said second power source.

5. The reference voltage generator of claim 2, wherein said second first-conductive type MOS transistor comprises:

a plurality of sub MOS transistors connected in parallel to one another; and a plurality of fuses for trimming which are respectively intervened in current paths of said plural sub MOS transistors.

6. The reference voltage generator of claim 5, wherein respective wirings between said plural sub MOS transistors and said plural fuses are shielded from a substrate on which said reference voltage generator is fabricated and from other signal wirings with a conductor having a potential of said first power source.

7. The reference voltage generator of claim 2, wherein said resistor is made of a polysilicon to which impurity is heavily doped so that said resistor has a resistance having a small temperature dependency.

8. The reference voltage generator of claim 2, wherein said resistor and a wiring between said resistor and the source of said second second-conductive type MOS transistor are respectively shielded from a substrate on which said reference voltage generator is fabricated and from other signal wirings with a conductor having a potential of said second power source.

9. The reference voltage generator of claim 2, wherein a part of the plural MOS transistors composing said load circuit comprises:

a plurality of sub MOS transistors connected in parallel to one another; and a plurality of fuses for trimming which are respectively intervened in current paths of said plural sub MOS transistors.

10. The reference voltage generator of claim 2, wherein a part of the plural MOS transistors composing said load circuit comprises:

a plurality of sub MOS transistors connected in series to one another; and a plurality of fuses for trimming which are respectively intervened between sources and drains of said plural sub MOS transistors.

11. The reference voltage generator of claim 2, wherein a potential of an output wiring of the reference voltage is fixed to a potential of said first power source so as to shield the output wiring from a substrate on which said reference voltage generator is fabricated and from other signal wirings.

12. The reference voltage generator of claim 2, wherein said constant current source further comprises:

a fifth second-conductive type MOS transistor intervened between said second power source and the drain of said second first-conductive type MOS transistor; and an inverter circuit for detecting a potential of the gate of said first second-conductive type MOS transistor and for controlling a potential of the gate of said fifth second-conductive type MOS transistor according to the thus detected potential.

13. The reference voltage generator of claim 12, wherein said inverter circuit comprises:

a sixth second-conductive type MOS transistor current-mirror-connected to said first second-conductive type MOS transistor; and a load intervened between said first power source and the drain of said sixth second-conductive type MOS transistor so as to control the potential of the gate of said fifth second-conductive type MOS transistor.

14. The reference voltage generator of claim 2, wherein said constant current source further comprises:

a seventh second-conductive type MOS transistor having a gate connected to the drain of said fourth second-conductive type MOS transistor, and intervened between the drain of said first first-conductive type MOS transistor and the drain of said second first-conductive type MOS transistor.

15. A constant current source, comprising:

a first first-conductive type MOS transistor having a source connected to a first power source;

a second first-conductive type MOS transistor having a source connected to said first power source;

a first second-conductive type MOS transistor intervened between a second power source and a drain of said first first-conductive type MOS transistor so as to be diode-connected in a forward direction;

a second second-conductive type MOS transistor having a drain connected to a drain of said second first-conductive type MOS transistor, a gate connected to a gate of said first second-conductive type MOS transistor and a source connected to said second power source;

a third second-conductive type MOS transistor intervened between said second power source and the drain of said second first-conductive type MOS transistor; and an inverter circuit for detecting a potential of the gate of said first second-conductive type MOS transistor and for controlling a potential of a gate of said third second-conductive type MOS transistor according to the thus detected potential.

16. The constant current source of claim 15, wherein said inverter circuit comprises:

a fourth second-conductive type MOS transistor current-mirror-connected to said first second-conductive type MOS transistor; and a load intervened between said first power source and the drain of said fourth second-conductive type MOS transistor so as to control the potential of the gate of said third second-conductive type MOS transistor.

* * * * *